US006216915B1

(12) United States Patent
Harman et al.

(10) Patent No.: US 6,216,915 B1
(45) Date of Patent: Apr. 17, 2001

(54) DUAL CHAMBER PACKAGE

(75) Inventors: Robert E. Harman, Perrysburg; Jeffrey J. Baltzell, Fremont, both of OH (US); Craig E. McClean, Harrisonburg, VA (US)

(73) Assignee: Owens-Brockway Plastic Products Inc., Toledo, OH (US)

( * ) Notice: Subject to any disclaimer, the term of this patent is extended or adjusted under 35 U.S.C. 154(b) by 0 days.

(21) Appl. No.: 09/379,528

(22) Filed: Aug. 24, 1999

(51) Int. Cl.[7] ..... B67D 5/52

(52) U.S. Cl. ..... 222/94; 222/137; 222/213; 222/391

(58) Field of Search ..... 222/135, 137, 222/391, 94, 213

(56) References Cited

U.S. PATENT DOCUMENTS

| | | | | |
|---|---|---|---|---|
| 3,866,800 | * | 2/1975 | Schmitt | 222/94 X |
| 4,067,479 | * | 1/1978 | Moline | 222/94 |
| 4,801,046 | | 1/1989 | Miczka . | |
| 4,826,044 | * | 5/1989 | Volfson | 222/94 |
| 4,846,371 | | 7/1989 | Pfanstiel . | |
| 4,865,231 | * | 9/1989 | Wiercinski | 222/391 X |
| 5,209,376 | * | 5/1993 | Dirksing | 222/137 X |
| 5,224,627 | | 7/1993 | Weag . | |
| 5,348,194 | * | 9/1994 | Mascitelli et al. | 222/213 X |
| 5,348,392 | * | 9/1994 | Bouquet et al. | 222/137 X |
| 5,363,990 | * | 11/1994 | Fillmore | 222/135 |
| 5,372,285 | * | 12/1994 | Harrold et al. | 222/391 X |
| 5,540,356 | | 7/1996 | Camm et al. . | |
| 5,564,598 | | 10/1996 | Camm et al. . | |
| 6,019,251 | * | 2/2000 | Koga | 222/94 |

* cited by examiner

*Primary Examiner*—Kevin Shaver
*Assistant Examiner*—Eric Keasel

(57) ABSTRACT

A dual chamber package for containing and simultaneously dispensing two individually contained fluent products which are not continuously externally pressurized. The package has an outer container body formed of a resilient plastic material, which is closed at one end, and a pair of collapsible containers contained within the outer container body for containing the fluent products out of contact with one another. A single elevator is positioned in within outer container body, initially near the closed end thereof, and in contact with closed ends of each of the collapsible containers. The elevator receives the free end of a walking stick in a one-way connection, and lifting of the walking stick causes the elevator to rise, thereby simultaneously dispensing small doses of the packaged products from the collapsible containers. Depression of the walking stick at the conclusion of a dispensing cycle leaves the elevator in position for the next dispensing cycle by virtue of the one-way connection between the walking stick and the elevator. Reciprocation of the walking stick is actuated by an opposed pair of generally L-shaped levers contained entirely within the outer container body, the flexibility of the outer container body permitting actuation of the L-shaped levers by a grasping load applied at opposed locations of the outer container body.

5 Claims, 2 Drawing Sheets

DUAL CHAMBER PACKAGE

FIELD OF THE INVENTION

This invention relates to a package for containing and simultaneously dispensing a plurality of fluent products. More particularly, this invention relates to a package of the foregoing character in which each of the products is not continuously externally pressurized in its as packaged condition.

BACKGROUND OF THE INVENTION

U.S. Pat. No. 5,363,990 (Fillmore) describes a pump package for containing and simultaneously dispensing two fluent products, specifically, viscous products. The package of this reference has an outer plastic body that is internally divided into two compartments, one for each of the packaged products. The package has a dispensing end through which each of the packaged products is dispensed, and each of the products is caused to flow to the dispensing end by a piston within the compartment in which such product is contained; thus, two such pistons are required for a package that contains two products. Obviously, of course, two piston rods are required to advance the pistons within their respective compartments, one for each piston, and a one-way spring connection is required by each piston and the piston rod that is used to advance it. Moreover, to actuate the movement of the piston rods, a lever system is provided, and the lever system, of necessity, is external to the outer plastic body, since the interior of the plastic body is filled with the packaged products. Thus, the lever system is subject to accidental actuation during shipment of a pump package according to this reference or during its display on a retail shelf.

U.S. Pat. No. 4,801,046 (Miczka) also discloses a package for containing and simultaneously dispensing two fluent products, and teaches that each such product be contained within a collapsible container, both collapsible containers being positioned within an outer container body. The collapsible containers are caused to collapse by the motion of a common piston within the container body. However, the motion of the piston requires that it be pressurized by a gas propellant filling, and such internally pressurized packages are expensive because of the need to be strong enough to be able to contain the propellant, and sufficiently well sealed to be able to do so without leakage.

GENERAL DESCRIPTION OF THE INVENTION

According to the present invention, there is provided a package for two or more fluent products, neither of which is continuously externally pressurized and each of which is contained out of contact with the other fluent product(s) in its own chamber or compartment of a flexible outer container body. Each packaged product is contained within a collapsible bellows, and dispensing occurs when the collapsible bellows are simultaneously collapsed by the advance of a common elevator within the outer container body, and toward a dispensing end of the package. The advance of the elevator is actuated by the reciprocation of a single rod that passes through the elevator, and has a one-way or ratchet connection to the elevator. Motion of the rod is actuated by a spring biased lever handle system made up of an opposed pair of handles, each of which is contained entirely within the outer body, but externally of each of the collapsible bellows within the outer body, the flexibility of the outer body serving to facilitate actuation of the handles by way of hand pressure. A valve is provided for each of the collapsible bellows to close its outlet during periods in which no dispensing is occurring, and each valve is interconnected to the handles of the container to open the outlet from the bellows during the dispensing of the packaged product therein.

Accordingly, it is an object of the present invention to provide an improved package for containing and simultaneously dispensing two or more fluent products that are not externally pressurized. More particularly, it is an object of the present invention to provide a package of the foregoing character in which the manually actuatable handles for actuating the dispensing of the packaged products are contained within the outline of a flexible outer container and are shielded from inadvertent disengagement during shipment and display on a retail shelf. It is also an object of the present invention to provide a package of the foregoing character with a valve for releasing each of the fluent products only during the dispensing of the fluent product.

For a further understanding of the present invention and the objects thereof, attention is directed to the drawing and the following brief description thereof, to the detailed description of the preferred embodiment and to the appended claims.

DETAILED DESCRIPTION OF THE PREFERRED EMBODIMENT

Figure 1:
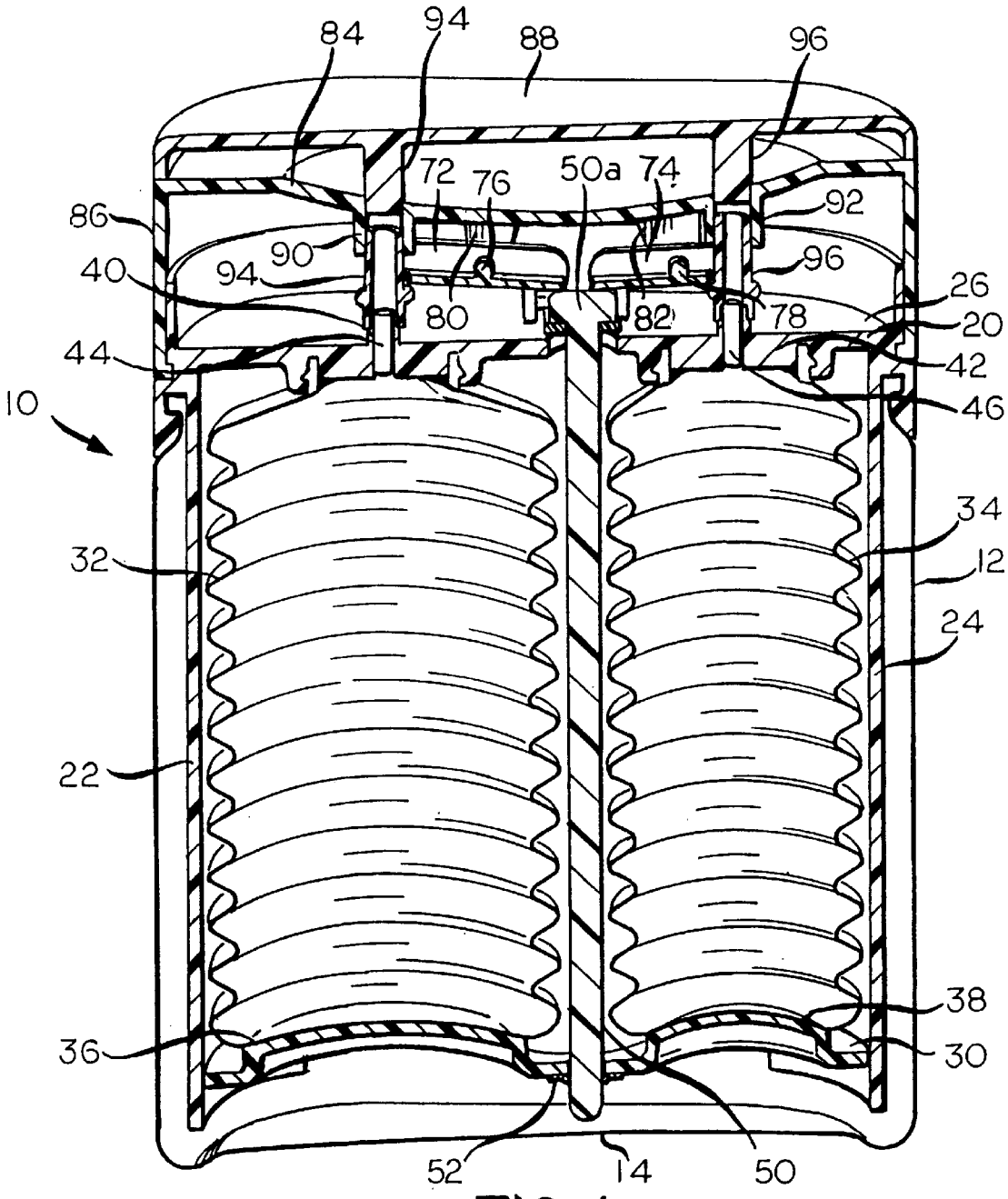
FIG. 1 is perspective front view, partly in cross-section, of a dual chamber package according to the preferred embodiment of the present invention.

A package according to the preferred embodiment of the present invention is identified generally by reference numeral 10 in the drawing. The package 10 includes an outer container body 12 that has a closed end 14, the opposed end of the container body 12, which is the dispensing end of the package 10, being open. The container body 12 is formed of a thermoplastic material in a single piece, and must have sufficient flexibility to be squeezable by hand, for purposes that will be hereinafter described more fully.

The open end of the container body 12 has a molded plastic fitment 20 frictionally secured to the container body 12 by a snap fit. The fitment 20 has depending arcuate fingers 22, 24 positioned within the container body 12. The fingers 22, 24 are double-ended, with ends that are spaced apart, and depend from a transversely extending portion 26 of the fitment 20 to locations adjacent the closed end 14 of the container body 12. A molded plastic, generally planar elevator 30 is positioned within the container body 12, internally of and in sliding engagement with the interior of each of the fingers 22, 24.

The package 10 is also provided with a plurality of collapsible bellows-type containers, shown as the containers 32, 34, positioned within the container body 12. The containers 32, 34 have closed ends 36, 38, initially positioned adjacent to the closed end 14 of the container body 12. The closed ends 36, 38 of the containers 32, 34, respectively, are supported on the elevator 30. First and second fluent products, not shown, are contained within the containers 32, 34, respectively, out of contact with one another until they are dispensed from the package 10 in unison, as will be hereinafter described in greater detail. The packaged products are not continuously externally pressurized as in the case of fluent products packaged in an aerosol pressurized container, but it is contemplated that either or both of them may be somewhat internally pressurized, for example, in the case of a shaving gel that contains a pressurizing agent, such as isopentane, that causes the gel to foam upon its discharge to atmospheric pressure.

The end of the containers 32, 34 that are opposed to the closed ends 36, 38, respectively, are open, and each is secured by a snap fit to the underside of the transversely extending portion 26 of the fitment 20. The transversely extending portion 26 of the fitment 20 is provided with apertures 40, 42 extending therethrough to permit the products in the containers 32, 34, respectively, to be dispensed through the transversely extending portion 26 of the fitment 20. The apertures 40, 42 are normally closed by pins 44, 46, respectively, that are slidable therein. The pins 44, 46 will slide from closing positions in the apertures 40, 42, respectively, in which they block the flow of products from the containers 32, 34, respectively, when the products in the containers 32, 34 are pressurized by the motion of the elevator 30 toward the open end of the container body 12 as will be hereinafter described more fully.

The elevator 30 has an elongate walking stick 50 passing therethrough, a spring-type ratchet member 52 being provided on the underside of the elevator 30 to receive a free end portion of the walking stick 50. The ratchet member 52 permits one-way relative movement between the elevator 30 and the walking stick 50, namely downward movement of the walking stick 50 relative to the elevator 30, in the orientation depicted in the drawing. Thus, when the walking stick 50 is moved in an upward direction, as will be hereinafter described more fully, the elevator 30 will also move upwardly, to thereby pressurize the products contained in the containers 32, 34 and simultaneously dispense such products through the apertures 40, 42, respectively. However, when the walking stick 50 thereafter moves downwardly, the elevator 30 will remain in the position it reached upon conclusion of the prior upward movement of the walking stick 50. Thus, products in the containers 32, 34 will be gradually dispensed in small doses by repeated reciprocation of the walking stick 50 along its longitudinal central axis.

Reciprocation of the walking stick 50 along it longitudinal central axis is actuated by an opposed pair of generally L-shaped levers 60, 62. The levers 60, 62 are provided with long generally downwardly extending legs 64, 66, respectively, and short, inwardly extending legs 68, 70, respectively, that extend generally perpendicularly with respect to the legs 64, 66, respectively. The legs 68, 70 are bifurcated, having upper portions 68*a*, 70*a*, respectively, and lower portions 68*b*, 70*b*, respectively. The upper portions 68*a*, 70*a* of the legs 68, 70, respectively, engage the exterior of an enlarged head portion 50*a* of the walking stick 50, and the lower portions 68*b*, 70*b* of the legs 68, 70, respectively, engage the underside of the head portion 50*a* of the walking stick 50. The lower portions 68*b*, 70*b* of the legs 68, 70, respectively, are pivoted with respect to the fitment 20 at pivot points 72, 74, respectively, and when the levers 60, 62, are pivoted inwardly by inward pressure on the downward legs 64, 66, respectively, the lower portions 68*b*, 70*b* of the inward legs 68, 70, respectively, will cause the walking stick 50 to move upwardly, and thereby cause elevator 30 to move upwardly, as previously explained. The inward motion of the downward legs 64, 66 is actuated by hand by a user grasping the container body 12, the squeezabilty of the container body 12, as previously explained, permitting inward motion of the downward legs 64, 66 by inwardly directed force applied at opposed locations of the container body 12.

Figure 2:
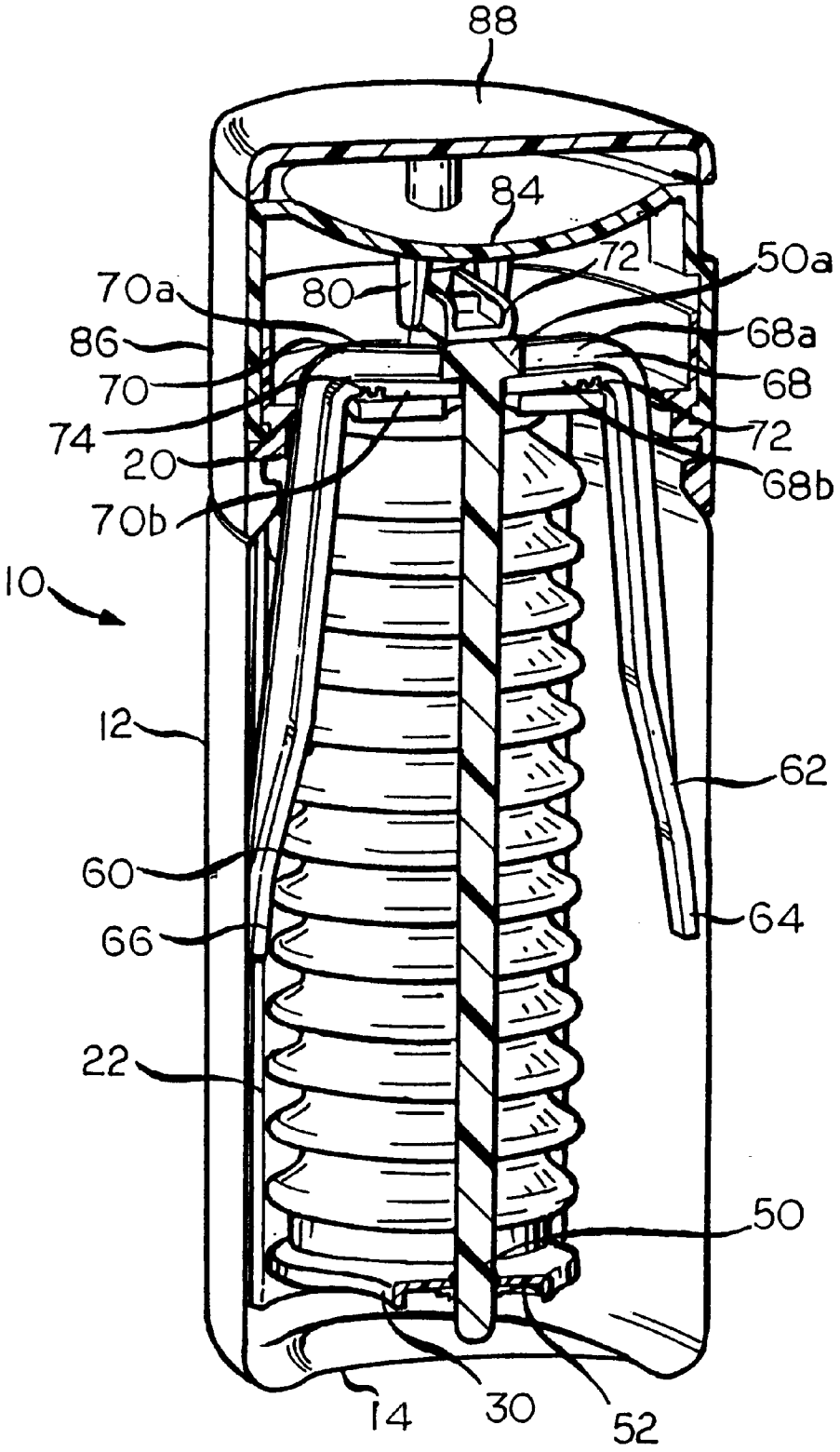
FIG. 2 is perspective side view, partly in cross-section, of the dual chamber package of FIG. 1.

The walking stick 50 is normally biased downwardly by an opposed pair of levers 72, 74 whose interior free ends bear against the top of the head portion 50*a* of the walking stick 50. The levers 72, 74 are pivoted about axes 76, 78, respectively, that pass through projections 80, 82, respectively, which extend downwardly from a top panel portion 84 of a cup-shaped molded plastic fitment 86. The molded plastic fitment 86 is frictionally secured to the fitment 20 above the level of the junction between the fitment 20 and the container body 12, and is normally closed by a cover member 88 that is hingedly connected to fitment 86, the opening of the cover member 88 with respect to other portions of the fitment 86 being indicated by the arrow in FIG. 2. The top panel portion 84 of the fitment 86 is provided with dispensing apertures 90, 92 in alignment with the apertures 40, 42, respectively, and the apertures 90, 92 are closed when the cover member 88 is closed with respect to other portions of the fitment 86 by projections 94, 96, respectively, that extend downwardly from the cover member 88.

To dispense products from the containers 32, 34 of the package 10 the cover member 88 of the fitment 86 is opened and the container body 12 is squeezed to pivot the downwardly extending legs 64, 66 of the levers 60, 62, respectively, inwardly. This will cause the walking stick 50 to move upwardly, as heretofore explained, thereby pressurizing the contents of the containers 32, 34. Simultaneously, this squeezing action will cause the levers 72, 74 to pivot about the axes 76, 78, respectively, thereby causing the outer free ends of the levers 72, 74, to depress, an action that will cause sleeves 94, 96, respectively, to depress therewith, thereby lowering the pins 44, 46 within the apertures 40, 42, respectively. This will permit the now pressurized contents of the containers 32, 34 to simultaneously exit through the apertures 90, 92, respectively, in the top panel portion 84 of the fitment 86. Upon release of the grasping pressure on the container body 12, the downwardly extending legs 64, 66 of the levers 60, 62, respectively, will move outwardly under a resilient force imposed on the head portion 50*a* of the walking stick 50 by the levers 70, 72 as a result of the upward deflection in the top panel portion 84 of the fitment 86 occurring during a dispensing phase. This load on the head portion 50*a* of the walking stick 50 will return the walking stick 50 to its original position, but its position with respect to the elevator 30 will be altered by virtue of the one-way connection between the walking stick 50 and the elevator 30, as heretofore explained.

A package 10 of the type described is useful in simultaneously dispensing separate products that are advantageously mixed together at the time of utilization, but not before. Certain formulations of shaving products advantageously consist of a mixture of separate products that are not continuously externally pressurized and are not mixed until the time of use, and the package 10, as heretofore described, has utility for such an application. As shown in the drawing, the containers 32, 34 are differently sized, and this will lead to dispensing of the products therefrom at a fixed ratio that is greater or lesser than 1:1. Of course, the dispensing of products at any other fixed ratio can be achieved by suitably sizing the internal volumes of the containers 32, 34 relative to one another.

Although the best mode contemplated by the inventors for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. A package for containing and simultaneously dispensing first and second fluent products which are not continuously externally pressurized, said package comprising:

an outer container body having an outlet end, said outer container body being formed from a resilient, thermoplastic material;

first collapsible means contained within said outer container body for containing the first fluent product;

second collapsible means contained within said outer container body for containing the second fluent product;

elevator means contained within said outer container body in engagement with each of said first collapsible means and said second collapsible means for simultaneously collapsing said first collapsible means and said second collapsible means to simultaneously discharge said first and second fluent products from said first and second collapsible means at first and second locations adjacent said outer end of said outer container body;

walking stick means in engagement with said elevator means for moving said elevator means to simultaneously engage said first collapsible means and said second collapsible means, said walking stick means engaging said elevator means for one-way relative motion of said walking stick means with respect to said elevator means; and actuation means for actuating said walking stick means to move said elevator means;

wherein said actuation means comprises;

an opposed pair of generally L-shaped levers, said opposed pair of generally L-shaped levers being contained entirely within said outer container body, each of said opposed pair of generally L-shaped levers having a downwardly extending leg and an inwardly extending leg, each of said opposed pair of generally L-shaped levers being pivoted for motion with respect to said outer container body and being pivotable with respect to said outer container body by virtue of an inwardly directed grasping load applied against opposed locations of said outer container body.

2. A package according to claim 1 wherein the inwardly extending leg of each of said opposed pair of generally L-shaped levers engages said walking stick means to raise said walking stick means upon inward pivoting motion of the downwardly extending leg of each said opposed pair of generally L-shaped levers.

3. A package according to claim 2 and further comprising:

a first valve means for closing said first collapsible means when the first fluent product is not being dispensed therefrom; and a second valve means for closing said second collapsible means when the second fluent product is not being dispensed therefrom;

inward pivoting of said opposed pair of generally L-shaped levers being effective to open said first valve means and said second valve means to permit dispensing of the first fluent product and the second fluent product.

4. A package according to claim 1 in which the ratio of a volume of the first collapsible means to a volume of the second collapsible means is substantially greater or less than 1:1.

5. A package according to claim 1 in which at least one of the first and second fluent products contains a pressurizing agent therein.

second collapsible means contained within said outer container body for containing the second fluent product;

an opposed pair of generally L-shaped levers, said opposed pair of generally L-shaped levers being contained entirely within said outer container body, each of said opposed pair of generally L-shaped levers having a downwardly extending leg and an inwardly extending leg, each of said opposed pair of generally L-shaped levers being pivoted for motion with respect to said outer container body and being pivotable with respect to said outer container body by virtue of an inwardly directed grasping load applied against opposed locations of said outer container body.

inward pivoting of said opposed pair of generally L-shaped levers being effective to open said first valve means and said second valve means to permit dispensing of the first fluent product and the second fluent product.

* * * * *